US005298118A

United States Patent [19]

Devic

[11] Patent Number: 5,298,118

[45] Date of Patent: Mar. 29, 1994

[54] PREPARATION OF BLEACHED CHEMITHERMOMECHANICAL PULP

[75] Inventor: Michel Devic, Sainte-Foy-Les Lyon, France

[73] Assignee: ATOCHEM, Puteaux, France

[21] Appl. No.: 919,389

[22] Filed: Jul. 29, 1992

Related U.S. Application Data

[63] Continuation of Ser. No. 695,321, May 3, 1991, abandoned, which is a continuation of Ser. No. 378,995, Jul. 12, 1989, abandoned.

[30] Foreign Application Priority Data

Jul. 12, 1988 [FR] France ..... 88 09703

[51] Int. Cl.[5] ..... D21C 1/06; D21C 9/16

[52] U.S. Cl. ..... 162/26; 162/72; 162/78; 162/80; 162/83; 162/84

[58] Field of Search ..... 162/26, 72, 78, 80, 162/83, 84

[56] References Cited

U.S. PATENT DOCUMENTS

| | | | |
|---|---|---|---|
| 3,388,037 | 6/1968 | Asplund et al. | 162/26 |
| 4,116,758 | 9/1978 | Ford et al. | 162/83 |
| 4,259,148 | 3/1981 | Beath et al. | 162/83 |
| 4,767,499 | 8/1988 | Simonson et al. | 162/26 |
| 4,804,440 | 2/1989 | Libergott et al. | 162/83 |

OTHER PUBLICATIONS

Kruper et al., "Oxygen/Peroxide Bleaching of Sulphite Pulp-A Possibility For Brightness Improvement".

*Primary Examiner*—Steve Alvo

*Attorney, Agent, or Firm*—Burns, Doane, Swecker & Mathis

[57] ABSTRACT

Bleached chemithermomechanical wood pulp having a high degree of whiteness is economically prepared by mechanically disintegrating and chemically digesting lignocellulosic material with sulfite at a temperature of at least 100°C. under saturated water vapor pressure and thereafter bleaching the pulp thus treated with hydrogen peroxide in an alkaline medium, and wherein no solids or liquids are removed from the pulp from the outset of treatment through completion of the bleaching step.

12 Claims, 2 Drawing Sheets

PREPARATION OF BLEACHED CHEMITHERMOMECHANICAL PULP

This application is a continuation of application Ser. No. 07/695,321, filed May 3, 1991, now abandoned, which is a continuation of application Ser. No. 07/378,995, filed Jul. 12, 1989, now abandoned.

BACKGROUND OF THE INVENTION

1. Field of the Invention

The present invention relates to the preparation of bleached chemithermomechanical wood pulp.

2. Description of the Prior Art

"Chemithermomechanical pulps", hereinafter CTMP pulps, are known to this art as pulps produced by treating (digesting) a lignocellulosic material, generally wood in the form of chips, with one or more chemical agents, combined with the operations of heating and mechanical separation of fibers.

CTMP pulps have a unique industrial worth as they constitute a favorable compromise between purely mechanically disintegrated pulps and purely chemically digested pulps.

For example, they are produced in a yield, weight of pulp relative to the weight of the starting materials in the dry state, of generally greater than 85%, most typically at least equal to 90%. In this respect they very closely approximate pulps of purely mechanical origin.

In the combined operation indicated above of heating, chemical treatment and fiber separation, the chemical treatment may be carried out either before, during or after the fiber separation.

By "chemical treatment" is intended that operation, over the course of which the lignocellulosic material is digested with a sulfite, notable sodium sulfite, $Na_2SO_3$, or a bisulfite, notably sodium bisulfite, $NaHSO_3$, or, more generally, a mixture of sulfur dioxide, $SO_2$, and sodium hydroxide, NAOH, at a temperature equal to or greater than 100° C. under saturation water vapor pressure. Such sulfite, bisulfite or mixture thereof will hereinafter collectively be designated as the "sulfite". The chemical treatment potentially includes a conventional impregnation of the lignocellulosic material with a solution of the selected reagents.

The temperature at which the treatment is carried out generally does not exceed 200° C. and preferably ranges from about 120° to 160° C.

The treatment medium is at an initial pH preferably ranging from 6 to 12.5.

Its consistency, concentration by weight of the pulp expressed in the dry state in the medium, typically ranges from 10% to 40%, most usually from 15% to 30%.

The duration of the treatment depends on the selection of other process parameters, but generally does not exceed 1 hour.

Expressed in terms of $SO_2$, the amount of the sulfite ranges, for example, from approximately 0.1% to 10%, most typically from 0.5% to 3%, with the percentages being given by weight relative to the weight of the lignocellulosic material in the dry state (this convention will also be used in the description which follows, unless otherwise indicated).

Certain chemical agents may be used in the treatment together with the sulfite, for example complexing or sequestering agents, such as diethylenetriaminepentaacetic (DTPA) or ethylenediaminetetraacetic (EDTA) acid used in the form of the sodium salts in amounts generally ranging from 0.1% to 1%.

The combination, as indicated above, of the chemical treatment with the operations of heating and mechanical grinding generally is carried out, in actual practice, with two successive (two-stage) refining operations, to render the pulp usable in conformity with paper industry requirements.

Specifically as regards the production of CTMP pulps, see the text by James P. Casey, *Pulp and Paper Chemistry & Chemical Technology*, 3rd edition, Vol. I, 1980, in particular pages 241–245, 213–219–229, the text *Pulp & Paper Manufacture*, Vol. 2, 1987, "Mechanical Pulping", in particular Chapters VIII D and XI, and U.S. Pat. No. 4,718,980, in particular FIG. 1.

By "bleached CTMP pulps" are intended the above CTMP pulps, after they are bleached by means of hydrogen peroxide, $H_2O_2$, in an alkaline medium.

In the known process for the preparation of bleached CTMP pulps, prior to bleaching with hydrogen peroxide, chemical agents such as sulfite ions must be removed as completely as possible, as it is known that they effect a consumption of $H_2O_2$ which is detrimental to the bleaching process, as reported, for example, by H. Kruger & H. U. Suss, *TAPPI Proceedings*, International Sulfite Pulping Conference, pp. 143–148 (1982).

In actual practice, the paste is carefully washed prior to bleaching. Conventionally, this is carried out, for example, by means of a potentially repeated sequence of dilution and reconcentration of the pulp.

When an operation of screening/cleaning of the refined pulp is carried out, as is generally the case, the dilution should adjust the consistency to a range of values as low as approximately 0.5% to 2%. Concerning washing and screening/cleaning, see the above Casey reference, pages 228–231, 363–365, 447–452, and the above *Pulp & Paper Manufacture* text, in particular Chapters XIII–XVIII.

Reconcentrating the pulp to be bleached to a consistency equal to at least about 10%, from very low values, is an operation required by the known process, not only to efficiently eliminate the chemical agent or agents considered to be undesirable in bleaching, but also such that the hydrogen peroxide will have a satisfactory effectiveness in the absence of these compounds.

The bleaching of the CTMP pulp by means of hydrogen peroxide in an alkaline medium is typically carried out by introducing an amount of hydrogen peroxide of from approximately 0.5% to 10%, in the presence of about 1% to 6% of a sodium silicate solution having a density of 1.33, at a pH of from approximately 9 to 11 and at a temperature of from about 40° C. to 100° C. for from about 0.5 to 2 hours, at a consistency of approximately 10% to 30%. The bleaching bath may also contain certain additives, principally one or more sequestering or complexing agents, such as, for example, DTPA, in amounts generally ranging from approximately 0.1% to 1%.

After bleaching, the pulp is preferably treated with an acid, such as, for example, $SO_2$, to stabilize the bleaching, prior to being diluted with water to a very low consistency, for example on the order of 1%, to permit its transport, its storage and its use in papermaking operations.

The existing process for the preparation of bleached CTMP described above and considered in relation to the manufacture of paper has certain serious disadvantages relative to economy and/or pollution:

(i) The production of a very large amount of aqueous effluents, about 100 tons per ton of paper; and (ii) The necessary reconcentration of the pulp prior to bleaching, which involves the use of expensive equipment, filters or a press for the pulp, for example, in spite of which it remains difficult to obtain a high consistency (which is known to favor the bleaching action of the hydrogen peroxide).

The aqueous effluents, which originate essentially in the operations of washing, screening/cleaning, the separation of water of the final dilution prior to or during the production of paper (depending on whether or not this production is integrated with the preparation of the pulp), which contain practically no sulfite, but are still high in pollutants, are necessarily recycled and in particular are used as a washing agent for the pulp, in order to eliminate the sulfite prior to the bleaching with hydrogen peroxide.

These effluents will hereinafter be designated as "clear industrial water."

In spite of the effective washing of the bleached CTMP pulp produced, its degree of whiteness remains appreciably less than that obtained by the use of natural demineralized and not recycled water, an application that unfortunately is not feasible from an economic standpoint alone.

SUMMARY OF THE INVENTION

Accordingly, a major object of the present invention is the provision of an improved process for the production of bleached CTMP pulps, which improved process conspicuously avoids the above disadvantages and drawbacks to date characterizing the state of this art and without the degree of whiteness of the final product pulps being adversely affected.

Indeed, it has now unexpectedly and surprisingly been found that a degree of whiteness is realized that is at least equal to that attained using the known industrial process, if, prior to bleaching, the chemical agent or agents heretofore considered to be harmful to bleaching by means of hydrogen peroxide are not in fact removed.

Briefly, the present invention features a process for the preparation of bleached CTMP pulps, comprising treating a lignocellulosic material with a sulfite at a temperature equal to or higher than 100° C. under saturated water vapor pressure, and then bleaching the pulp with hydrogen peroxide in an alkaline medium, but wherein no solids or liquids are removed from the pulp from the very outset of the process to the completion of the bleaching operation.

DETAILED DESCRIPTION OF THE PREFERRED EMBODIMENTS OF THE INVENTION

Figure 1:
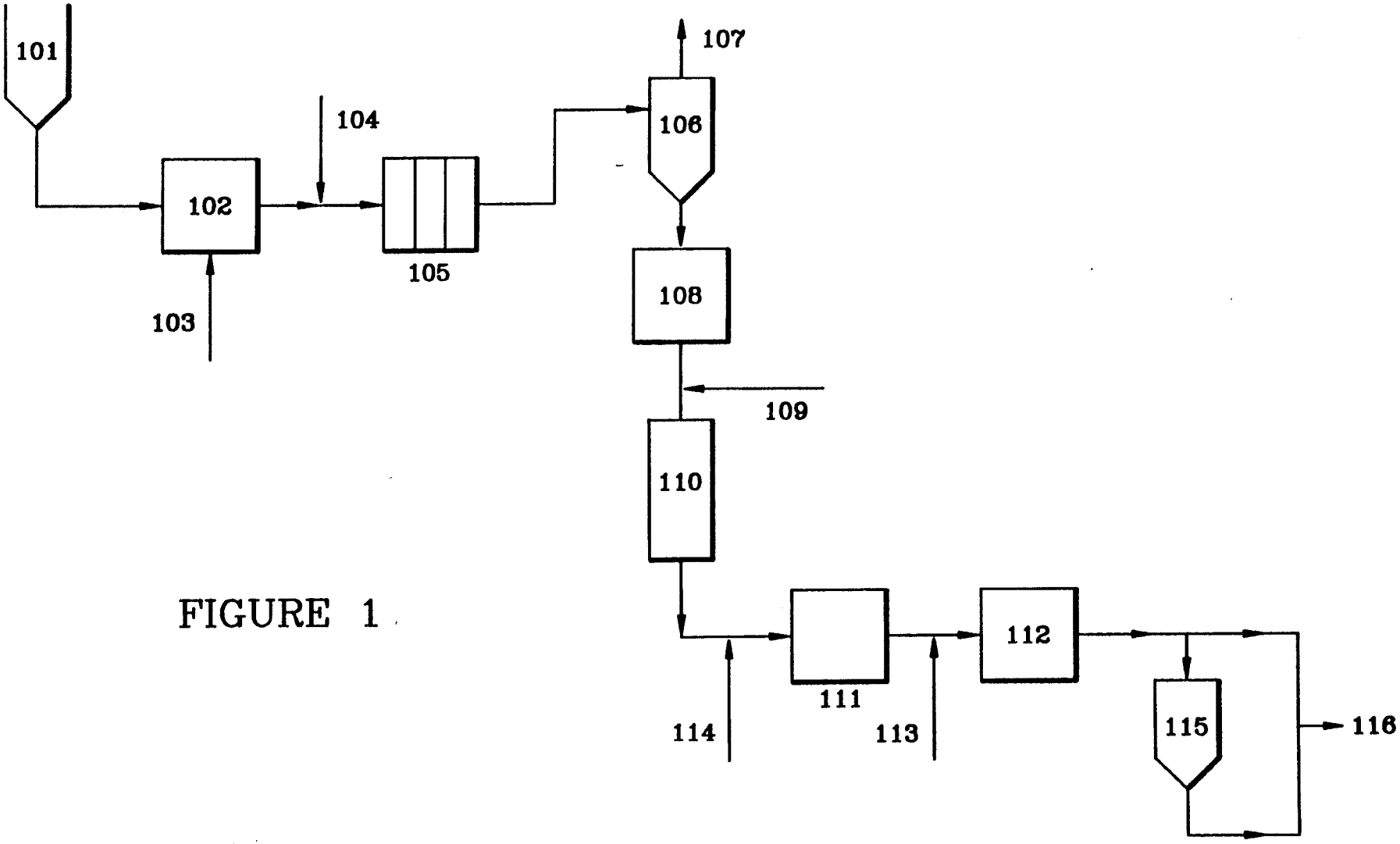
FIG. 1 is a schematic/diagrammatic illustration of a preferred embodiment of the process according to the invention.

More particularly according to the present invention, it will be appreciated that no solids/liquids are removed subsequent to refining and prior to bleaching, and that during this sequence the operations of washing, screening/cleaning (classification) and the reconcentration of the pulp are not carried out. As the chemical treatment is carried out during a refining operation, a residence time of about 5 to 30 min at the outlet temperature of the refiner, in a latent zone, suffices to effect the treatment.

Only the water vapor, for example at the outlet of a pulping operation, may be separated from the pulp between the onset of the treatment and the completion of the bleaching, for example in a cyclone, in known manner.

In a preferred embodiment of the invention, it has also surprisingly been found that the results of the process are even enhanced, if a chemical agent more electronegative than the sulfite ion $SO_3^{--}$, hereinafter designated as the "reductant", acts simultaneously with the sulfite during the treatment.

The reductant is advantageously selected from among thiourea dioxide or formamidinesulfinic acid, sodium hydrosulfite or dithionite, or sodium borohydride.

The amount of the reductant used may vary as a function of its nature. It generally ranges, for the first two noted reductants, from about 0.1% to 54, and from approximately 0.01% to 0.5% for the third, which is conveniently used in the form of an aqueous solution, such as, for example, a solution containing 12% by weight sodium moronydride and marketed by Ventron under the trademark BOROL ®.

As a practical matter, the process of the invention is especially useful for the production of CTMP pulps having a high degree of whiteness, for example 80° or more, when measured in the conventional manner using a wave length of 457 nm, with magnesium oxide as the reference standard, by means of a spectrophotometer of the General Electric or Elrepho type. The amount of the sulfite, expressed as $SO_2$, then preferably ranges from about 0.5% to 3%, and the amount of hydrogen peroxide preferably ranges from 3% to 10%, most preferably from 4% to 6%.

This invention also features a process in which the bleached CTMP pulp is refined directly upon its exit from the bleaching operation. This refining is carried out under atmospheric pressure. The advantage reported in U.S. Pat. No. 4,718,980 in the case of mechanical and thermomechanical pulps only is thus maintained in the case of bleached CTMP pulps without their having to be thickened.

Thus, this invention also features a process for the preparation of bleached CTMP pulps wherein the bleached CTMP pulp is refined directly after bleaching and further wherein no solids or liquids are removed from the pulp from the outset of the process to the completion of refining after the bleaching operation.

Screening/cleaning may thus be carried out on the bleached and refined pulp. The dilution using clear industrial water and the recycling of the screening/cleaning waste to the refiner of the bleached pulp are thus effected without disadvantage.

The process of the invention, in which the pulp is not reheated, makes it possible to eliminate the introduction of energy from an external source into the system, provided that the conservation of the energy of the system is sufficiently assured.

The process of the invention therefore saves both mechanical and thermal energy relative to the known processes.

The invention is applicable both to soft woods or resinous woods and to hard woods or deciduous woods.

The different operations according to the invention are carried out in apparatus that is conventional, both relative to their structure and their respective functions.

Referring specifically to FIG. 1 of the Drawings, wood chips, usually washed, are conveyed from a feeder hopper 101 to chamber 102, the chamber preheating the chips by means of steam introduced via line 103. The preheated chips are transferred, together with the solution of reagents introduced via line 104, into a refiner 105 and then into a cyclone 106, where the water vapor is separated via line 107. From the outlet of cyclone 106, the pulp is transferred through the latent zone 108, prior to being intimately admixed with the bleaching reagents introduced via line 109, and are then bleached in the bleaching tower 110. The bleached pulp exiting the tower 110 is introduced directly into the refiner 111 under atmospheric pressure, from which it exits to be screened/cleaned in vessel 112, after dilution with clear industrial water introduced via line 113. The screening/cleaning waste, sufficiently reconcentrated, is refined separately (circuit not shown) or is recycled through line 114 to the inlet of the refiner 111. Downstream of vessel 112, the pulp is acidified in known manner and transported to storage vessel 115 and/or to a papermaking operation via line 116.

Figure 2:
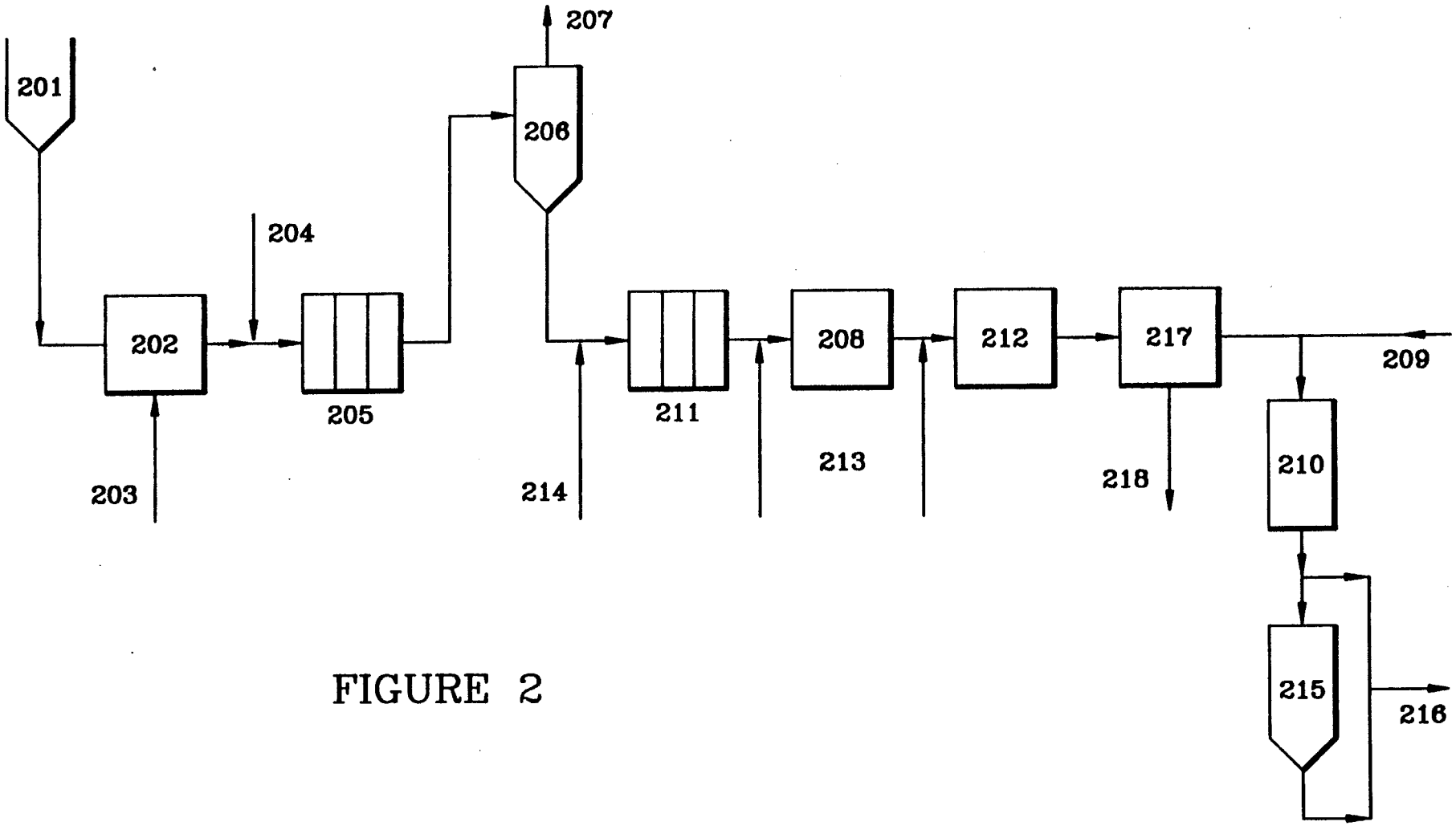
FIG. 2 is a schematic/diagrammatic illustration of a representative process of the prior art.

With respect to FIG. 2 of the Drawings, wherein structure/function corresponding to that of FIG. 1 is indicated by corresponding numbers, but in the two-hundred series rather than the one-hundred series, the supplementary vessel 217 is a thickening apparatus for the concentration of the pulp between its screening/cleaning in vessel 212 and its bleaching in tower 210. The aqueous effluent collected from vessel 217 via line 218 contributes to the formation of the clear industrial water, which is introduced via line 213 to serve as the washing agent for the pulp.

In order to further illustrate the present invention and the advantages thereof, the following specific examples are given, it being understood that same are intended only as illustrative and in nowise limitative.

In said examples to follow, (a) the respective amounts, indicated above, are expressed in % by weight relative to the lignocellulosic material in the dry state, unless otherwise indicated; (b) DTPA connotes a 40% by weight aqueous solution of sodium diethylenetriaminepentaacetic acid and the amount of DTPA is that of such solution; (c) "washing" connotes the operation combining the dilution and pressing of the pulp; (d) the sodium borohydride is used in the form of BOROL® and the amount indicated is that of this form; (e) "silicate" connotes an aqueous solution of sodium silicate having a density of 1.33; and (f) the degree of whiteness is measured at the wave length of 457 nm using magnesium oxide as the reference standard, by means of an ELREPHO type spectrophotometer manufactured by Karl Zeiss.

EXAMPLE 1

Wood chips were refined under saturated water vapor pressure, at 120° C., using 2.75% $Na_2SO_3$ to produce a pulp having a degree of whiteness of 57°.

This pulp was bleached, without any liquids or solids being removed, with admixture of 5% $H_2O_2$, 24 NAOH, 4% silicate, and 0.5% DTPA, for 2 hours, at 90° C., at a consistency of 15%.

The resulting bleached pulp had a whiteness of 77.9°.

If, prior to being bleached under the above conditions, the pulp was washed by dilution to a consistency of 1.25% using a clear industrial water obtained in an industrial reconcentrating installation by pressing to a consistency of 20%, such that 95% of the sulfite was eliminated prior to the addition of the bleaching reagents, its degree of whiteness after bleaching was 77.4°. It was thus lower than the degree of whiteness attained according to the invention.

If the aforesaid washing process were carried out using pure demineralized water instead of clear industrial water, the degree of whiteness of the bleached pulp, admitted to be the highest possible under the bleaching conditions specified, was higher by only 1.5° than that attained according to the invention.

EXAMPLE 2

A softwood stoneground wood pulp having a degree of whiteness equal to 53.7°, was treated under the pressure of saturated water vapor at 120° with 2.75% $Na_2SO_3$ and 0.5% DTPA for 30 min at a consistency of 20%, prior to being bleached directly, without removing any solids or liquids, as in Example 1.

The resulting bleached pulp had a degree of whiteness of 78.7°.

If the pulp were bleached after washing with clear industrial water as in Example 1, its whiteness was 78.6°, which is still less, or at best equal to that attained according to the invention.

EXAMPLE 3

Example 2 and the comparative example included therein were repeated, except that 1% BOROL® was present together with the sulfite.

When the operation was carried out according to the invention, the degree of whiteness of the bleached pulp was equal to 82.2°; it was only 80.9° in the comparative example.

If pure demineralized water were used in place of the clear industrial water, the degree of whiteness of the bleached pulp was higher by only 1% than that attained by the process of the invention.

While the invention has been described in terms of various preferred embodiments, the skilled artisan will i appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. A process for the preparation of bleached chemithermomechanical wood pulp having yields greater than 85% by weight relative to weight of the lignocellulosic material in the dry state, comprising mechanically disintegrating and chemically digesting a lignocellulosic material with a sulfite at a temperature of at least 100° C. under saturated water vapor pressure to produce a pulp containing residual sulfite and thereafter bleaching the pulp thus treated with hydrogen peroxide in an alkaline medium in the presence of the residual sulfite, wherein no solids or liquids are removed from the pulp from the outset of treatment through completion of the bleaching step.

2. The process as defined by claim 1, comprising treating said lignocellulosic material with a reductant simultaneously with the sulfite, said reductant being more electronegative than the sulfite ion.

3. The process as defined by claim 2, said reductant comprising thiourea dioxide, sodium borohydride or sodium dithionite.

4. The process as defined by claim 3, said reductant comprising thiourea dioxide or sodium dithionite, present in an amount of from about 0.1% to 5%.

5. The process as defined by claim 3, said reductant comprising sodium borohydride, present in an amount of from about 0.01% to 0.5%.

6. The process as defined in claim 1, wherein the treatment medium has an initial pH ranging from about 6 to 12.5.

7. The process as defined by claim 1, wherein the amount of sulfite ranges from 0.5 to 3% by weight, expressed as sulfur dioxide, and the amount of hydrogen peroxide in the bleaching step ranges from 3% to 10%.

8. The process as defined by claim 7, said amount of hydrogen peroxide ranging from about 4% to 6%.

9. The process as defined by claim 1, further comprising directly refining said bleached pulp without removing any solids or liquids therefrom.

10. The process as defined by claim 1, said lignocellulosic material comprising a hard wood.

11. The process as defined by claim 1, said lignocellulosic material comprising a soft wood.

12. The process as defined by claim 1, wherein the sulfite is selected from among sodium sulfite, sodium bisulfite, or mixtures thereof.

* * * * *